United States Patent [19]

Glascock

[11] Patent Number: 4,790,141

[45] Date of Patent: Dec. 13, 1988

[54] APPARATUS AND PROCESS FOR QUICK FREEZING OF BLOOD PLASMA

[75] Inventor: Battle Glascock, Knoxville, Tenn.

[73] Assignee: Industrial Gas and Supply Company, Bluefield, W. Va.

[21] Appl. No.: 132,024

[22] Filed: Dec. 14, 1987

[51] Int. Cl.[4] ..... F24F 3/16

[52] U.S. Cl. ..... 62/78; 62/407; 62/457; 62/514 R

[58] Field of Search ..... 62/388, 407, 78, 514 R, 62/457

[56] References Cited

U.S. PATENT DOCUMENTS

| | | | |
|---|---|---|---|
| 2,049,708 | 8/1936 | Lieb | 62/518 |
| 2,523,530 | 9/1950 | Brown | 62/388 |
| 3,092,974 | 6/1963 | Haumann | 62/64 |
| 3,431,745 | 3/1969 | Harper | 62/63 |
| 4,107,937 | 8/1978 | Chmiel | 62/64 |
| 4,218,892 | 8/1980 | Stephens | 62/514 R |
| 4,306,425 | 12/1981 | Sitte et al. | 62/514 R |
| 4,377,077 | 3/1983 | Granlund | 62/457 |
| 4,388,814 | 6/1983 | Schilling | 62/62 |
| 4,535,604 | 8/1985 | Cavalli | 62/342 |
| 4,537,034 | 8/1985 | Crouch | 62/78 |
| 4,573,329 | 3/1986 | Cavalli | 62/342 |
| 4,667,478 | 5/1987 | Jones | 62/64 |

*Primary Examiner*—Ronald C. Capossela

*Attorney, Agent, or Firm*—Dowell & Dowell

[57] ABSTRACT

Quick cryogenic freezing of blood plasma is accomplished by providing a conductive cylinder mounted in a nitrogen container, the cylinder loosely fitting a standard plasma bottle to provide for heat transfer from the bottle by conduction and space for passage of vapor, the cylinder walls having longitudinally extending ducts connected at their upper ends to the head space above the liquid nitrogen and discharging through injection ports spaced along the ducts and directed inwardly against the bottle, the vapor being drawn along the sides of the bottle and discharged outwardly of the apparatus.

9 Claims, 4 Drawing Sheets

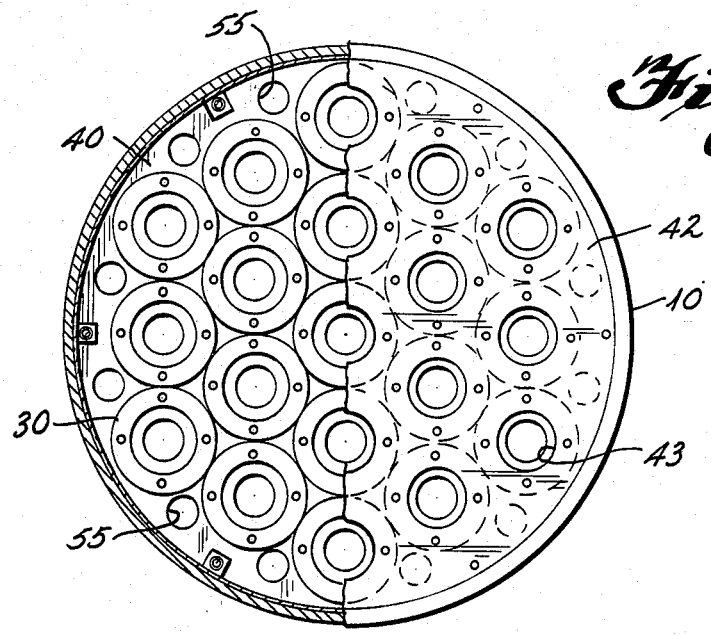
Fig. 4
Fig. 5
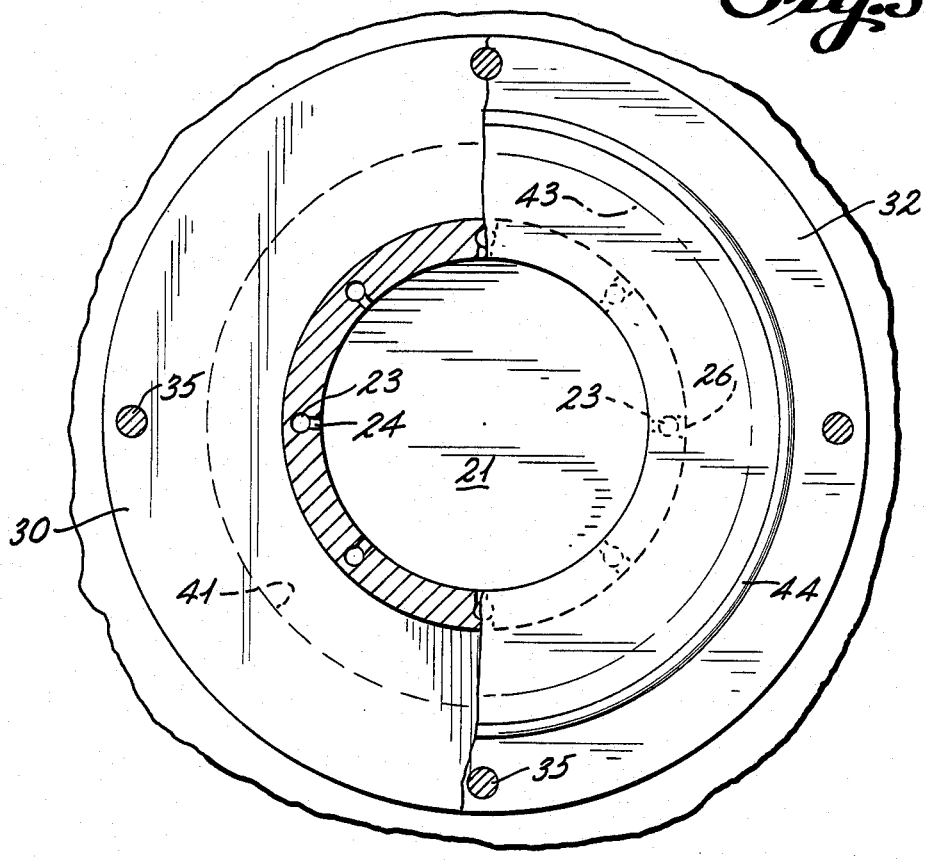

25
44
43
32
44
42
45
34
35
26
26
30
35
40
24
24
31
41
44
23
24
15
20
24
21

10
44
35
57
42
51
59
56
50
52
26
30
56
55

APPARATUS AND PROCESS FOR QUICK FREEZING OF BLOOD PLASMA

FIELD OF THE INVENTION

This invention relates to appartus and processes for freezing a product, and more particularly to the cryogenic freezing of blood plasma.

BACKGROUND OF THE INVENTION

The current market for blood plasma in the United States is large, annually grossing approximately 1.5 billion dollars. Two major procedures for the processng of blood plasma are used by major processing plants in the United States and worldwide.

Blood plasma is processed into anti-hemophiliac factor, commonly known as Factor 8. Blood is usually drawn from donors into two 300 ml. plastic bags. The whole blood is taken to a processing lab and placed in a centrifuge. After a cycle time, the red blood cells and platelets are separated from the blood plasma. Because the red blood cells and the platelets are heavier, they are forced to the bottom of the plastic bag by the centrifuge. The plasma is then drawn off the top the bag and is stored in a 600 ml. hard plastic bottle.

On the average, a donor produces 400-500 ml. of plasma at each donation. The plasma is frozen and stored in walk-in coolers to be shipped at a later date to a processing plant. The processing plant turns the plasma protein into anti-hemophiliac factor.

Freezing methods commonly used by the industry are as follows:

Method I

The blood plasma from the donor is placed in a 600 ml. bottle. The bottle is placed in an alcohol bath at −79° C. The heat within the bottle is drawn out by conduction through its walls and by free convection on the outside of the bottle to the alcohol bath. The prime mover is the temperature gradient. Because the bottles are in a liquid atmosphere, the plasma generally freezes in about two hours. The freezing temperatures as specified by the U.S. Food and Drug Administration (FDA) are −18° C. for frozen plasma and −30° C. for long term storage.

The technicians are required to work in an alcohol-rich atmosphere. This is hazardous not only because the technicians are dealing with a very cold liquid exposed in an open air tank but also with a flammable substance. After being frozen the bottles are placed in a walk-in cooler maintained at the required −30° C. for long term storage.

If the plasma center has a large number of donors in a day then the alchohol freezers tend to increase in temperature therefore increasing the freezing time. An attempted solution is the use of dry ice in conjunction with the alcohol although this is both expensive and hazardous.

Method II

Another common method for freezing plastic plasma bottles is merely to place them directly in the walk-in freezer. Because the FDA requires that the plasma must be frozen within six hours after donation, such method does not always comply with the regulations, due to the fact that the walk-in freezers are maintained at a temperature of −30° C., the heat transfer at such temperature being only marginally sufficient.

Because plasma is a protein and subjected to decay when outside the body, a rapid freezing method is desireable. However, current methods of rapid freezing are expensive and affordable only by large plasma centers. If the smaller centers have a large number of donors in one day, then its cooler is required to work harder in order to maintain the −30° C. temperature and may not be able to comply with the FDA regulations.

DESCRIPTION OF THE PRIOR ART

The U.S. Pat. Nos. to Lieb 2,049,708 and Kavalli 4,535,604 and 4,573,329 disclose evaporators of conventional high and low side refrigeration systems in which the evaporator is in heat exchange relation with a cylindrical walled vessel which may be removable.

Haumann et al. U.S. Pat. No. 3,092,974 discloses freezing a product by exposing it to vaporized nitrogen gas within container.

Harper et al. U.S. Pat. No. 3,431,745 discloses transporting a product on a conveyor through a tunnel in which the product is initially sprayed with liquid nitrogen and later contacted with gaseous nitrogen.

Chmiel U.S. Pat. No. 4,107,937 discloses liquid nitrogen spray and immersion appartus incorporating an electric heater and control means for controlling the temperature gradient of the product.

Schilling U.S. Pat. No. 4,388,814 discloses controlling the temperature of a product by varying its level above the surface of liquid cryogen in a container having high thermal conductivity.

Jones U.S. Pat. No. 4,466,478 discloses introducing vaporous cryogen into a chamber for cooling a product therein.

OBJECT OF THE INVENTION

It is an object of the invention to improve the processing of blood plasma, thereby conserving this vital resource.

A further object of the invention is to provide an apparatus and method by which a product such as blood plasma may be frozen at a much greater rate than that which is presently commonly practiced.

It is a further object of the invention to provide a method for rapidly freezing blood plasma which is safe, the technicians not being exposed to cold liquids or a flammable substance.

A still further object of the invention is to increase the processing ability of a product freezing plant in order that its facilities may be used more efficently, such processing being carried out by readily available cooling media.

SUMMARY OF THE INVENTION

The foregoing objects are attained through use of the apparatus and method of the present invention. The apparatus includes a cryogenic tank having a novel cooling tower therein into which the container of blood plasma is placed, the construction and arrangement being such that rapid cooling occurs due to both conduction and convective transfer of heat by the cryogenic liquid and vapor simultaneously.

BRIEF DESCRIPTION OF THE DRAWINGS

FIG. 4 is a section on the line 4—4 of FIG. 3.

FIG. 5 is a section, to an enlarged scale, on the line 5—5 of FIG. 3.

DESCRIPTION OF THE PREFERRED EMBODIMENT

Figure 1:
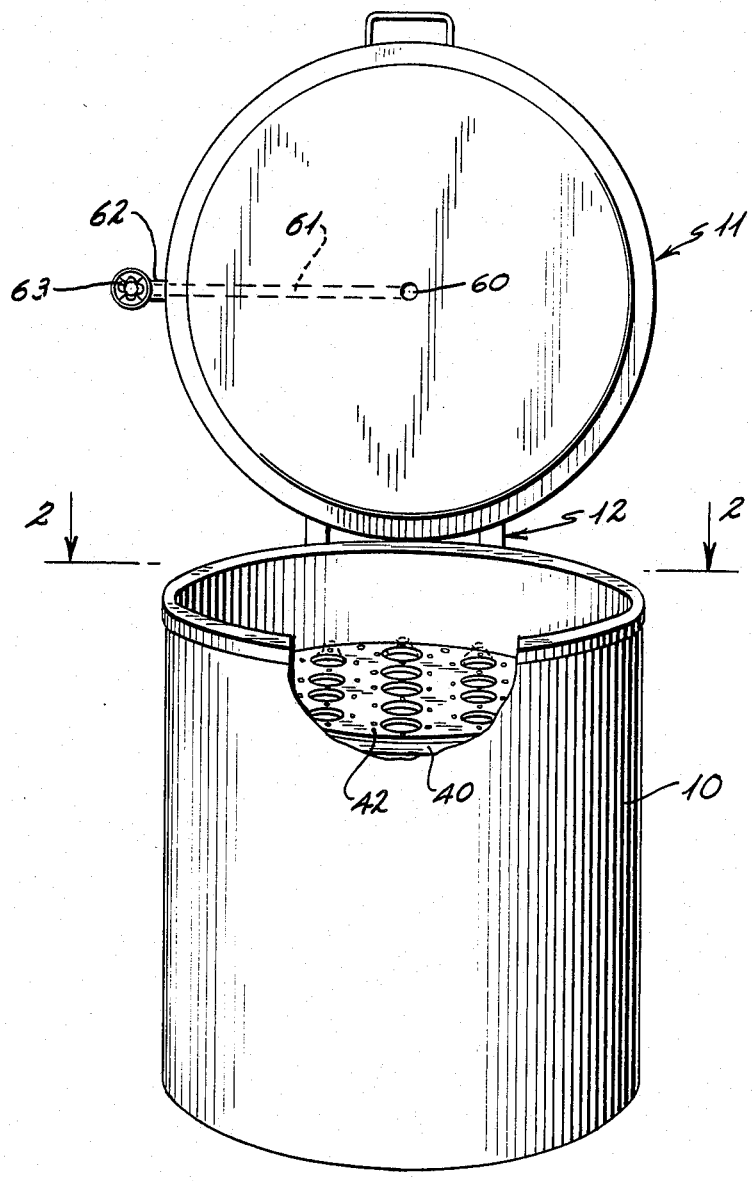
FIG. 1 is a perspective of an assembly, partially broken away, of the present invention.
Figure 2:
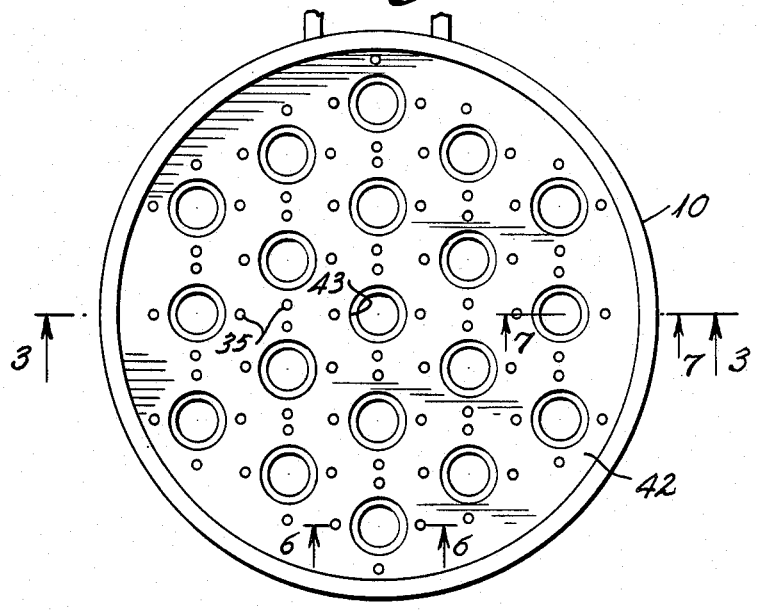
FIG. 2 is a top plan view with the cover removed.
Figure 3:
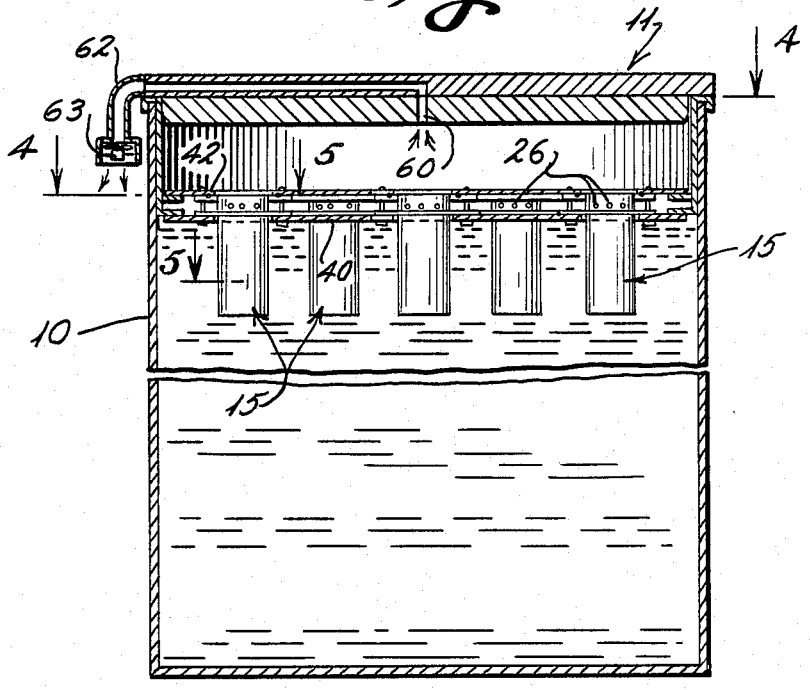
FIG. 3 is a vertical section on the line 3—3 of FIG. 2.

With particular reference to FIG. 1, there is illustrated a cryogenic container having incorporated therein an embodiment of the present invention. The cryogenic container has an outer wall 10 and a lid 11 which is connected thereto by a hinge 12. The container may be supported on a dolly and have handles, not shown, to facilitate its movement. The container walls and bottom have super insulation and a thick lid for maintaining heat loss to a minimum. The container may be provided (not shown) with various liquid fill and liquid level controls and an alarm in order to provide the user with the appropriate control and monitoring systems. As described thus far the container may be a standard cryogenic container, well known in the art for the storage of cryobiological specimens.

In accordance with the present invention, the container has provision for mounting one or more thermally conductive towers or receptacles 15 with their upper ends in spaced relation below the top of the container. The number of such towers depends on the dimensions of the cryogenic container that is selected. In the embodiment illustrated there are nineteen such receptacles or cooling towers.

Figure 6:
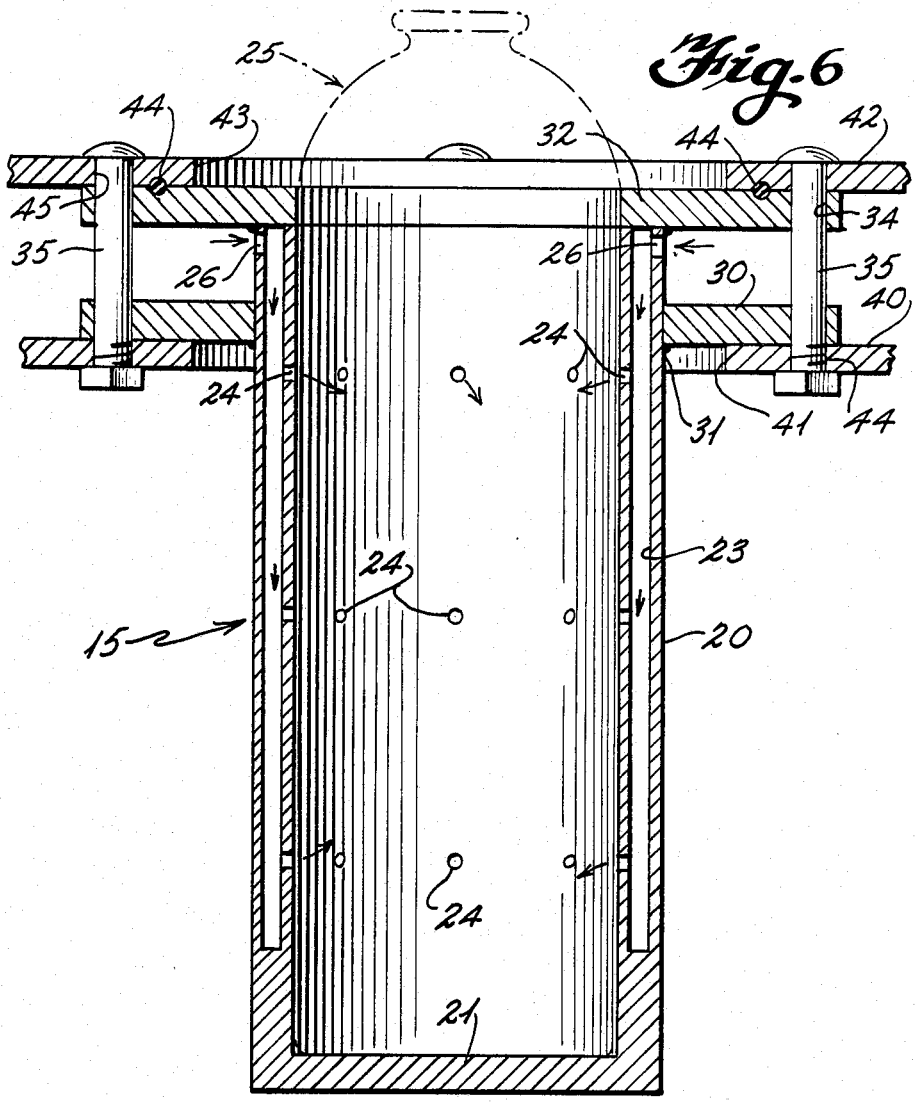
FIG. 6 is a vertical section, to an enlarged scale, on the line 6—6 of FIG. 2, illustrating an individual cooling tube or tower.

With further reference to FIG. 6, each of the cooling towers has a tubular side wall 20, a closed end wall 21, and an inner wall surface 22. The tubular side wall has a series of spaced longitudinal ducts 23 running from adjacent to its top to a location close to its bottom but spaced sufficiently thereabove so that the side wall is not unduly weakened. Each of the ducts 23 has a series of spaced outlet ports 24 along its length which permit gas therein to jet inwardly into contact with the outer wall 25 of a container of substance that is to be frozen. At the upper end of the wall 20 each of the ducts has an inlet opening 26 for receiving the gas.

In order to mount the tower within the container, a flange 30 extends outwardly from the upper portion thereof being connected by weld 31. A second flange 32 extends from the upper extremity of the tube 20. Flange 30 has spaced bolt holes 33 and flange 32 has spaced bolt holes 34 in alignment therewith for purposes of receiving bolt 35 for connecting it to the mounting structure which will be presently described.

A lower plate 40 having openings 41 to receive the cooling towers supports the flange 30. An upper plate 42 having openings 43 is connected to the flange 32. A vapor seal 44 is mounted in grooves between the flange 32 and the plate 42. Plate 40 has spaced bolt holes 44 and plate 42 has spaced bolt holes 45 in alignment with the bolt holes 33 and 34 for receiving the bolts 35.

Figure 7:
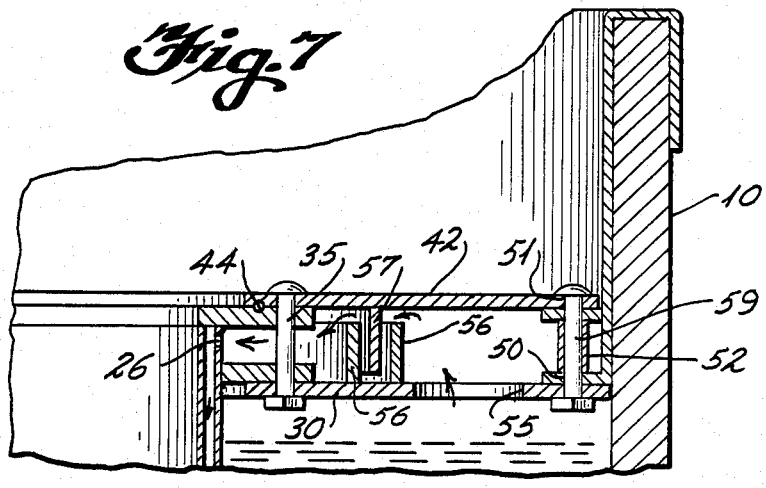
FIG. 7 is a vertical section, to an enlarged scale, on the line 7—7 of FIG. 2.

In order to support the mounting plates within the container, the inner walls of the container (see FIG. 7) have a pair of spaced inwardly extending rings or flanges 50, 51 with a spacer 52 therebetween for connection respectively to the lower and upper mounting plates 40 and 42. The lower mounting plate 40 has a series of openings 55 adjacent to the outer wall of the container for the passage of nitrogen vapor into the space between the mounting plates 40 and 41. There are preferably included also baffle means 56 and 57 extending in a ring around the area between the upper and lower mounting plates. The outer periphery of the mounting plates 40 and 42 are connected to the flanges 50 and 51 by suitable fastening means 59.

In order to permit the evolving cryogen gas to escape from the space over the top of the mounting plate 42 within the container, the lid 11 of the container has a discharge opening 60 which is connected to a duct 61 and to an external discharge tube 62 which may have a motor driven fan 63 therein or connected thereto.

A typical hard plastic bottle for blood plasma has an outside diameter at the bottom of 3.10" and at the top 3.20". In order to provide a space between it and the inner wall 20 of the tower for the passage of gas the inner wall in a preferred embodiment has an inside diameter of 3.25".

In the operation of the device the bottles of blood plasma are placed within the receptacles or towers 20 as indicated in the drawings, the liquid level of the cryogenic liquid, ordinarily nitrogen, at that time being just below the mounting plate 40. The lid is then closed. The conductive walls 20 of the cooling towers rapidly conduct heat from the plasma container, thereby causing the nitrogen gas to be evolved along the sides of the walls 20 and into the space just beneath the mounting plate 40 from which it passes upwardly through the openings 55 into the space between the upper and lower mounting plates and then into the openings 26 at the upper portions of the towers 20 from which it passes downwardly through the ducts 23 and is jetted outwardly through the ports 24 into contact with the sides of the plasma container 25. From here the gas passes upwardly along the sides of the plasma container and out past the top thereof into the space beneath the lid of the container from which it is discharged.

Various modifications may obviously be made. For example instead of the containers 20 being of circular cross section, they may be polygonal for holding flexible bags of plasma.

The heat transfer due to the conduction through the cooling tower walls which are in contact with the liquid nitrogen and the convection due to the rapid passage of nitrogen vapor combine to rapidly freeze the product. A standard hard plastic bottle of blood plasma is ordinarily frozen in fifteen minutes, thus permitting rapid handling of the product. Nitrogen is the preferred cryogen due to its low boiling point (−195.8° C.), its safety, and ready availablity.

I claim:

1. Apparatus for cryogenic freezing of an article having wall means, comprising a thermally conductive cooling tower having side walls for receiving in close proximity the wall means of said article, an upper open end and a closed lower end, duct means extending along said side walls and having inlet means at the exterior upper portion of said side walls and port means intermediate said upper and lower ends for discharging vapor inwardly into contact with the wall means of an article received in said cooling tower.

2. The invention of claim 1, said cooling tower mounted in a container for cryogenic liquid, said container having walls, and plate means extending from the upper end of said cooling tower and in sealed relation therewith and with said walls of said container.

3. The invention of claim 2, said container having a removable lid, and means above said plate means for discharging vapor from said container.

4. The invention of claim 2, in which a plurality of cooling towers are mounted in a container.

5. The invention of claim 1, in which said article and said side walls are substantially cylindrical and the diameter of said side walls exceeds that of said article by approximately 0.05 to 0.15 inches.

6. The invention of claim 1, in which the articles are bottles of blood plasma, said bottles being approximately cylindrical.

7. The invention of claim 1, in which the articles are bags of blood plasma, and said side walls have a cross section of polygonal configuration.

8. For use with a cryogenic container having upstanding walls, a bottom, an open top, and a removeable lid, the improvement comprising, plate means extending transversely of said walls and between said bottom and open top, said plate means in sealed relationship with said walls, thermally conductive cooling tower means having side walls, a closed bottom and an open top, said plate means receiving the upper portion of said cooling tower means and in sealed relationship with the side walls thereof, said cooling tower means having duct means extending along its side walls from adjacent its upper portion to a position therebelow, said duct means having inlet means at its upper portion for receiving vapor from beneath said plate means, said duct means having port means for discharging vapor inwardly, said container having means for discharging vapor which is in the space above said plate means, whereby liquid cryogen in said container at a level just below said plate means is in thermally conductive relation with a cryobiological container in said cooling tower means, and whereby evolving cryogen vapor passes through said duct means and said port means into contact with said cryobiological container, said vapor passing upwardly along said container in heat exchange relation therewith into the space above said plate means for discharge from said cryogenic container.

9. The invention of claim 8, and a second plate means extending transversely of said container walls and in spaced relation just below said first mentioned plate means, said second plate means mounted in said container and connected to and supporting said cooling tower means, and means for the passage of vapor from said container past said second plate means into the space immediately beneath said first mentioned plate means.

* * * * *